US006527616B1

(12) United States Patent
Li

(10) Patent No.: US 6,527,616 B1
(45) Date of Patent: Mar. 4, 2003

(54) THROWING TOY FOR PRODUCING SPLASH EFFECT

(75) Inventor: Daniel Hak Li, Quarry Bay (HK)

(73) Assignee: JS Vision Ltd., Hong Kong (CN)

( * ) Notice: Subject to any disclaimer, the term of this patent is extended or adjusted under 35 U.S.C. 154(b) by 0 days.

(21) Appl. No.: 10/106,471

(22) Filed: Mar. 25, 2002

(51) Int. Cl.[7] ..... A63B 65/00
(52) U.S. Cl. ..... 446/267; 473/574; 473/614
(58) Field of Search ..... 473/609, 614, 473/573, 574, 594; 446/71, 74, 267

(56) References Cited

U.S. PATENT DOCUMENTS 3,601,923 A * 8/1971 Rosenberg ..... 446/267
3,676,387 A * 7/1972 Lindlof ..... 524/489
4,236,715 A * 12/1980 Middlebrook ..... 156/306.3
4,929,211 A * 5/1990 Resnick et al. ..... 446/14
4,952,190 A * 8/1990 Tarnoff et al. ..... 446/267
5,066,018 A * 11/1991 Hinton ..... 473/572
5,290,041 A * 3/1994 Kettelson ..... 273/400
5,577,723 A * 11/1996 DiResta et al. ..... 446/184
5,649,875 A * 7/1997 Spector ..... 473/596
5,975,983 A * 11/1999 Panec ..... 446/475
6,109,998 A * 8/2000 DiResta et al. ..... 446/184

* cited by examiner

*Primary Examiner*—Jacob K. Ackun
(74) *Attorney, Agent, or Firm*—Jack Lo

(57) ABSTRACT

The present throwing toy is comprised of a sticky elastomer shell around a liquid core. The shell is comprised of a thermoplastic rubber mixed with a petroleum based oil in a ratio that produces an extremely soft shell. The core is comprised of clarified water. When the toy is thrown against a wall, it greatly flattens to produce a splash effect, sticks to the wall temporarily, slowly reforms into its original shape as it drips down the wall, and falls off the wall.

8 Claims, 2 Drawing Sheets

THROWING TOY FOR PRODUCING SPLASH EFFECT

BACKGROUND OF THE INVENTION

1. Field of the Invention

The invention broadly relates to elastomer toys.

2. Prior Art

A toy sold under the trademark "WACKY WALL WALKER" is an octopus-shaped device composed of a single material—a sticky elastomer. It has just enough adhesion so that when it is is thrown onto a wall, it does not bounce off but slowly crawls downs the wall under the pull of its own weight. Other elastomer toys include resilient balls that deform when squeezed, and slowly return to their original shapes. Since the "WACKY WALL WALKER", there has not been an elastomer toy that produces a truly novel effect.

BRIEF SUMMARY OF THE INVENTION

The present throwing toy is comprised of a sticky elastomer shell around a liquid core. The shell is comprised of a thermoplastic rubber mixed with a petroleum based oil in a ratio that produces an extremely soft shell. The core is comprised of clarified water. When the toy is thrown against a wall, it greatly flattens to produce a splash effect, sticks to the wall temporarily, slowly reforms into its original shape as it drips down the wall, and falls off the wall.

DRAWING REFERENCE NUMERALS

| | | | |
|---|---|---|---|
| 10. | Throwing Toy | 11. | Shell |
| 12. | Core | 13. | Nipple |
| 14. | Wall | | |

DETAILED DESCRIPTION OF THE INVENTION

FIGS. 1–2

Figure 1:
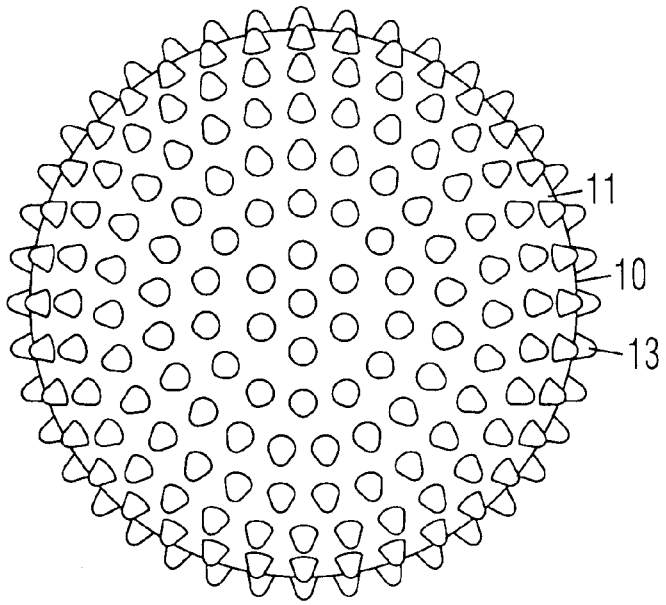
FIG. 1 is a front view of the present throwing toy.
Figure 2:
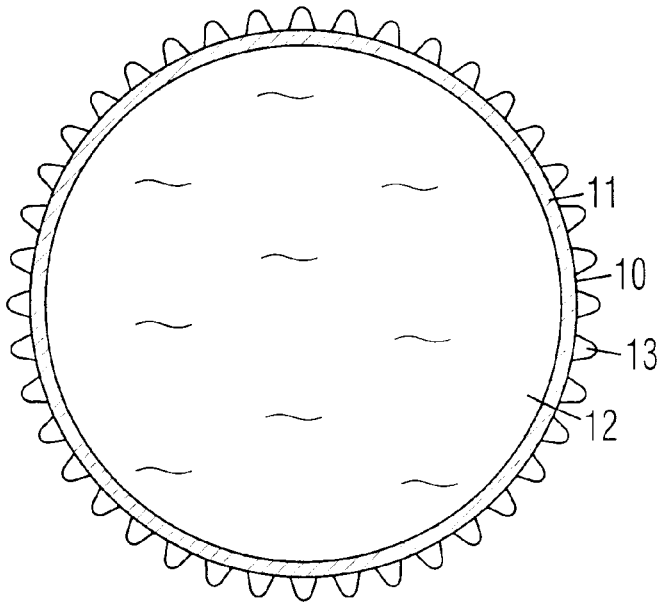
FIG. 2 is a sectional view thereof.

A preferred embodiment of the present throwing toy 10 is shown in a front view in FIG. 1 and a sectional view in FIG. 2. It is comprised of a sticky elastomer shell 11 surrounding a liquid core 12. Shell 11 is comprised of a thermoplastic rubber (TPR) mixed with a petroleum based oil in a ratio that produces a very sticky and soft shell. The type of thermoplastic rubber is preferably styrene ethylene propylene styrene copolymer (SEPS), and a suitable SEPS is sold under the trademark "SEPTON 4055" by Kuraray Co., Ltd. in Kashima, Ibaraki, Japan. An alternative material is "KRATON G-1651" sold by Shell in the United States. The ratio is preferably one part thermoplastic rubber to about six part oil, so as to result in a shell which is soft enough to produce the desired splash effect, yet still strong enough to prevent tearing during play. The ratio can vary from about four to eight part oil. Core 12 is comprised of a liquid with a low enough viscosity, such as that of water, to produce the splash effect. Core 12 is preferably comprised of clarified water and a preservative that prevents the water from decaying.

In this example, throwing toy 10 is shown as a spherical ball with nipples 13 distributed on its outer surface for facilitating molding. Alternatively, it may be of any other shape, such as monsters, animals, insects, human figures, cartoon characters, etc.

FIGS. 3–6

Figure 3:
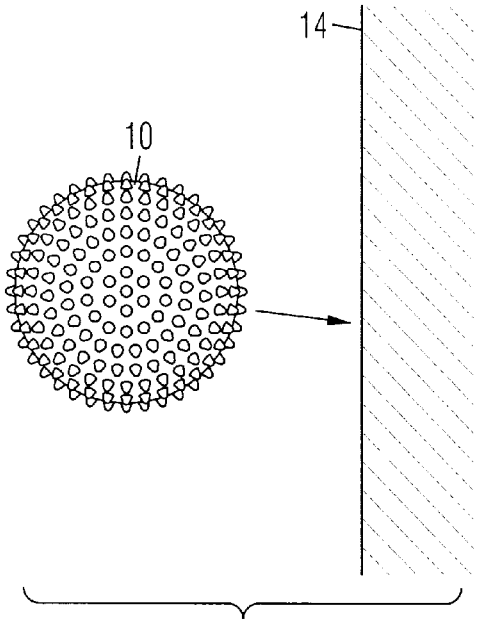
FIG. 3 is a side view thereof flying toward a wall.
Figure 4:
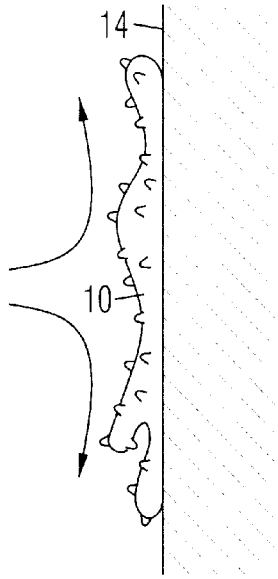
FIG. 4 is a side view thereof flattened into a splash effect on the wall.
Figure 5:
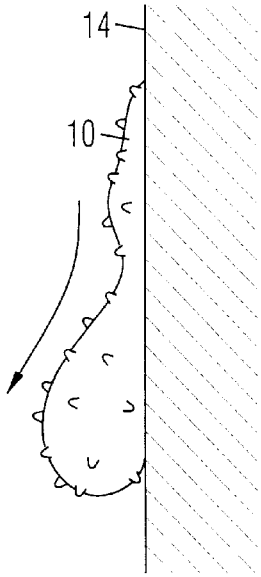
FIG. 5 is a side view thereof dripping down the wall and reforming.
Figure 6:
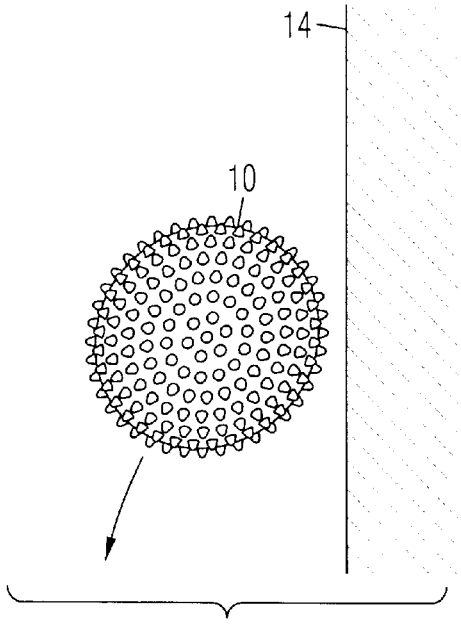
FIG. 6 is a side view thereof falling off the wall.

The effect produced by throwing toy 10 is shown in FIGS. 3–6. In FIG. 3, toy 10 is flying toward a wall 14 or other immobile object. In FIG. 4, toy 10 is greatly flattening against wall 14 and spreading outward to produce a fun splash effect. The tackiness of the shell material makes the toy temporarily stick to the wall. In FIG. 5, toy 10 is dripping down wall 14 under its own weight and slowly reforming into its original shape. In FIG. 6, toy 10 is falling off wall 14 since the tackiness of the shell material is insufficient to hold it on the wall.

Although the foregoing description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A throwing toy, comprising:

an elastomer shell; and a liquid core substantially filling said elastomer shell, wherein said liquid core has an overall viscosity generally equal to that of water; whereby when said toy is thrown against an immobile object, said toy is flattened against said immobile object to produce a splash effect due to said viscosity of said liquid core; wherein said elastomer shell is comprised of one part thermoplastic rubber and about four through eight parts petroleum based oil, so that said shell is soft enough to produce said splash effect, yet still strong enough to prevent tearing.

2. The throwing toy of claim 1, wherein said thermoplastic rubber is comprised of a styrene ethylene propylene styrene copolymer.

3. The throwing toy of claim 1, wherein said core is comprised of clarified water and a fly preservative that prevents said water from decaying.

4. The throwing toy of claim 1, wherein said shell is comprised of a spherical ball with nipples distributed on an outer surface thereof for facilitating molding.

5. A throwing toy, comprising:

an elastomer shell; and a water core within said elastomer shell; whereby when said toy is thrown against an immobile object, said toy is flattened against said immobile object to produce a splash effect; wherein said elastomer shell is comprised of one part thermoplastic rubber and about six part petroleum based oil, so that said shell is soft enough to produce said splash effect, yet still strong enough to prevent tearing.

6. The throwing toy of claim 5, wherein said thermoplastic rubber is comprised of a styrene ethylene propylene styrene copolymer.

7. The throwing toy of claim 5, further including a preservative in said water core for preventing decay.

8. The throwing toy of claim 5, wherein said shell is comprised of a spherical ball with nipples distributed on an outer surface thereof for facilitating molding.

* * * * *